US006138441A

United States Patent [19]

Kik et al.

[11] Patent Number: 6,138,441

[45] **Date of Patent: *Oct. 31, 2000**

[54] PROCESS FOR PRODUCTION OF HOTMELT ADHESIVES

[75] Inventors: Michael Kik, Langenfeld; Gerald Petry, Hueckelhoven; Lutz Huesemann, Haan; Joachim Holze; Alfred Biehle, both of Monheim; Bernhard Toeritz, Ratingen, all of Germany

[73] Assignee: Henkel Kommanditgesellschaft auf Aktien, Dusseldorf, Germany

[ * ] Notice: This patent issued on a continued prosecution application filed under 37 CFR 1.53(d), and is subject to the twenty year patent term provisions of 35 U.S.C. 154(a)(2).

[21] Appl. No.: 08/859,794

[22] Filed: May 19, 1997

Related U.S. Application Data

[63] Continuation of application No. 08/557,875, Nov. 14, 1995, abandoned, which is a continuation of application No. 08/298,511, Aug. 30, 1994, abandoned.

[30] Foreign Application Priority Data

Aug. 30, 1993 [DE] Germany ..... 43 29 114

[51] Int. Cl.[7] ..... B65B 3/02; B65B 9/12; B65B 9/20

[52] U.S. Cl. ..... 53/440; 53/451; 53/127; 53/551; 206/524.7

[58] Field of Search ..... 264/148; 206/447, 206/524.7; 53/127, 373.9, 289.1, 440, 450, 451, 452, 477, 478, 479, 550, 551, 511

[56] References Cited

U.S. PATENT DOCUMENTS

| | | | |
|---|---|---|---|
| 2,861,406 | 11/1958 | Holsman et al. | 53/440 |
| 2,872,763 | 2/1959 | Meissner | 53/29 |
| 3,298,156 | 1/1967 | Lerner | 53/440 |
| 3,317,368 | 5/1967 | Battersby | 161/175 |

(List continued on next page.)

FOREIGN PATENT DOCUMENTS

| | | |
|---|---|---|
| 35551 | 11/1965 | Germany . |
| 1611891 | 2/1968 | Germany . |
| 1511577 | 8/1969 | Germany . |

(List continued on next page.)

OTHER PUBLICATIONS

"Seife–Öle–Fette–Wachse", Die Chem: Techn. Industrie, (1976), pp. 279–282.

1981 English Translation of: Franz, R. "Kontinwerliche Aufbereitung von Hoftlebstoffen", 5 Müchener Klebstoff–und Veredelungs Seminar, 20–22 (Oct./1980) (Continous Compounding of Hotmelt Adhseives, pp. 95–104).

Encyclopedia of Polymer Science and technology, 1st edition. vol. 1, (1965), pp. 482–484.

Sybil P. Parker (editor), McGraw–Hill Dictionaryof Scientific and Technical Terms, McGraw–Hill (publisher), 4th edt. (1989), p. 1443.

Grant, R. et al., Grant & Hach's Chemical Directary, McGraw–Hill (publisher), 5 edt. (1987), p. 540.

*Primary Examiner*—John Sipos

*Attorney, Agent, or Firm*—Wayne C. Jaeschke; Stephen D. Harper

[57] ABSTRACT

In the production of a strand-form hotmelt adhesive wrapped in a tubular film which is suitable for simultaneous melting with the hotmelt adhesive and which does not have any surface tackiness at normal storage temperatures, the heated liquid hotmelt adhesive is introduced into the cooled tubular film and the tube is subsequently cooled in a cooling bath. During introduction of the hotmelt adhesive, the shape of the tubular film is stabilized by providing an excess gas pressure and/or a guide inside the tube. The outside of the tube is cooled by a cooling liquid, the tubular film is brought into a substantially horizontal position after immersion in the cooling bath and is kept in that position in the cooling bath at least until the contents of the tubular film in proximity with said liquid hotmelt adhesive have at least partly solidified. Strands of any diameter and any length can readily be produced without significant effort in an economically and industrially useful manner.

56 Claims, 4 Drawing Sheets

U.S. PATENT DOCUMENTS

| | | | |
|---|---|---|---|
| 3,469,363 | 9/1969 | Berckmoes | 53/25 |
| 3,528,826 | 9/1970 | Wilson | 53/127 |
| 3,542,570 | 11/1970 | Bush | 53/440 |
| 3,564,808 | 2/1971 | Kent | 53/25 |
| 3,987,602 | 10/1976 | Stahl | 53/25 |
| 4,396,529 | 8/1983 | Price et al. | 252/307 |
| 4,627,224 | 12/1986 | Hamamoto et al. | 53/502 |
| 4,719,741 | 1/1988 | Mabry | 53/451 |
| 4,964,259 | 10/1990 | Ylvisaker et al. | 53/551 X |
| 5,110,641 | 5/1992 | Kean | 428/35.5 |
| 5,222,346 | 6/1993 | Wegscheider et al. | 53/440 |
| 5,257,491 | 11/1993 | Rouyer | 53/428 |
| 5,333,439 | 8/1994 | Bozich et al. | 53/440 |
| 5,373,682 | 12/1994 | Hatfield et al. | 53/440 |
| 5,392,592 | 2/1995 | Bozich et al. | 53/440 |

FOREIGN PATENT DOCUMENTS

| | | |
|---|---|---|
| 2017401 | 3/1972 | Germany . |
| 2413575 | 9/1975 | Germany . |
| 2659695 | 9/1979 | Germany . |
| 3234065 | 4/1983 | Germany . |
| 3138222 | 5/1983 | Germany . |
| 4204396 | 8/1993 | Germany . |
| 7024822 | 8/1970 | Japan . |
| 431177 | 9/1967 | Switzerland . |
| 1375930 | 12/1974 | United Kingdom . |

PROCESS FOR PRODUCTION OF HOTMELT ADHESIVES

CROSS REFERENCE TO RELATED APPLICATION

This application is a continuation of application Ser. No. 08/557,875, filed Nov. 14, 1995, now abandoned which is a continuation of application Ser. No. 08/298,511 filed Aug. 30, 1994, now abandoned.

FIELD OF THE INVENTION

This invention relates to a making-up process for the production of strand-form hotmelt adhesive, more particularly contact hotmelt adhesive, wrapped in a tubular film which is suitable for melting together with the hotmelt adhesive and which does not show any surface tackiness at normal storage temperatures. In this process, the cooled tubular film is filled with the heated, liquid hotmelt adhesive and is then cooled in a cooling bath, more particularly in a water bath.

BACKGROUND OF THE INVENTION

Hotmelt adhesives are solventless adhesives which, after melting, are capable of thoroughly wetting surfaces of materials and firmly adhering to them after cooling and solidification. They do not undergo any chemical changes during the melting process. Hotmelt adhesives generally consist of a heterogeneous mixture of substances which form the adhesive component, the cohesive component and the additive component. There are many known starting components for the production of hotmelt adhesives, including for example ethylene/vinyl acetate copolymers, styrene copolymers, block polymers, such as polystyrene/butadiene/polystyrene, polystyrene/polyisoprene/polystyrene, polyamides, atactic polypropylene, natural and synthetic waxes, paraffins, fillers, antioxidants, antiagers, etc.

In the production of hotmelt adhesives, the components are melted in heated stirred tanks and then made up in pelleting or granulating machines. Particular difficulties are encountered in the making-up of so-called contact hotmelts, i.e. hotmelt adhesives with permanent tackiness, because they remain tacky at room temperature.

Various techniques have been developed for the making-up of these adhesives; some of them are described in the journal "Seife-Öle-Fette-Wachse" (1976), pages 279–282. It is known that the cooled, particulate hotmelt adhesive can be after treated to prevent the individual particles from sticking together. To this end, the pellets or granules are coated, for example by powdering, spraying or spray-coating. The disadvantage of this approach lies in the introduction of foreign matter into the adhesive so that its quality is generally reduced.

In another known process for making up hotmelt adhesives, silicone-coated paper or cardboard containers are filled with the hot adhesives. The individual blocks of adhesive are prevented from sticking to one another by leaving the paper container on the blocks until they are remelted by the user. The disadvantage of this process lies in the accumulation of non-reusable packaging material.

Another process for making up hotmelt adhesives, particularly contact hotmelts, is known from DE 32 34 065 A1. The exposure of the adhesive to high temperatures both during production and during processing is said to be significantly reduced in this process by extrusion of the adhesive to form a strand of any length and subsequent wrapping of the strand in a film. For processing, the adhesive is melted together with the film. It is possible in this way to wind the strand into a roll of the particular length required without any danger of the strands sticking together under the pressure of the roll in conjunction with the storage temperatures. Polyolefin films, such as polyethylene films, are used as the film. However, films of PVC or other vinyl chloride polymers and polyvinyl alcohol films may also be used, depending on the nature of the hotmelt adhesive to be wrapped. Where the hotmelt adhesives contain polyamides, polyamide films may also be used.

In the known process, the wrapping of the hotmelt adhesives in the film is generally carried out at a temperature below the melting temperature of the film, i.e. at temperatures in the range from 90 to 180° C. and more particularly at temperatures in the range from 95 to 130° C.

In the embodiment disclosed in the document cited above, a hotmelt adhesive is extruded through the nozzle of an extruder at a temperature of 120 to 130° C. to form a strand 20 to 25 mm in diameter. A 50 mm thick tubular film of polyethylene is guided over the nozzle head, being protected against premature heating by the nozzle head by an insulation which may additionally be coolable. After filling with the adhesive, the tubular film is cooled in a water bath. After cooling, the strand is wound into a roll.

A similar process for the production of hotmelt adhesives is described in DE 31 38 222 C1. In this case, too, a strand of a hotmelt adhesive is wrapped in a polyolefin film, the melting temperature being in the range from 130 to 200° C. and preferably in the range from 150 to 180° C. The document in question does not provide further particulars of the wrapping step, particularly in regard to the cooling phase.

The known filling of tubular films with hotmelt adhesive involves difficulties. The films particularly suitable for melting together with the adhesive generally have melting points below the temperature at which the film is filled with the hotmelt adhesive. Insulating the tubular film from the nozzle head is not sufficient on its own. Instead, provision has to be made for effective cooling of the tubular film while it is being filled to ensure that the tubular film does not develop leaks. Due inter alia to the need for effective cooling, another problem arises. In the conventional filling of tubular films with liquids, the hydrostatic pressure of the liquid inside the tube leads to a uniform and round shape. In the present case, however, the adhesive solidifies only a short time after introduction into the tubular film or at least becomes so viscous that the insides of the tubular film stick very easily to one another. In this case, the cross-sectional area of the tubular film at this point is very small, the cooling effect resulting in rapid solidification there. The tubular film becomes blocked and can only be partly filled. Another disadvantage of the known process lies in the relatively narrow diameter (approximately 20 to 25 mm) of the final adhesive strand. Diameters of around 80 mm are desirable for practical purposes. In the production of diameters as large as these, however, the cooling problems mentioned above and the problems caused by sticking of the tube become even greater. Although DE 32 34 065 A1 refers in general terms to the usefulness of strand diameters in the range from 1 to 10 cm, the making-up of strands such as these by this process involves enormous difficulties.

SUMMARY OF THE INVENTION

Accordingly, the problem addressed by the present invention was to overcome the above-mentioned difficulties involved in the introduction of the hotmelt adhesive into the tubular film so that strands of any diameter and any length can readily be produced without significant effort in an economically and industrially useful manner.

According to the invention, the solution to this problem is characterized in that, during introduction of the hotmelt adhesive, the shape of the tubular film is stabilized by providing an excess gas pressure, more particularly by means of compressed air, and/or a guide, more particularly a guide basket, inside the tube and the outside of the tube is cooled with a cooling liquid, more particularly water, and in that, after immersion in the cooling bath, the tubular film is brought into a substantially horizontal position and is kept in that position in the cooling bath at least until the contents of the tubular film have at least partly solidified. The cooling with water during introduction of the hotmelt adhesive provides for simple, effective and economic cooling which in turn provides for the use of tubular films of which the melting temperature is considerably lower than the working temperature prevailing during introduction of the adhesive. Thus, a hotmelt adhesive introduced into the tubular film at a temperature of around 160° C. can be wrapped in a polyethylene film with a melting and softening temperature of around 100° C. The increased danger during this effective cooling of the insides of the tubular film adhering to one another to the point where they can be no longer separated without damaging the tubular film after the rapid cooling is eliminated by the excess gas pressure and/or the guide inside the tubular film which is used for dimensional stabilization. The excess gas pressure can be built up by means of compressed air. However, other gases, for example inert gases, such as nitrogen, may also be used. The guide may assume the form of a guide basket, a guide ring, a guide cage or any other suitable element. If both a gas under pressure and a guide are used for dimensional stabilization, the excess pressure built up may be lower than where gas under pressure is used on its own.

DETAILED DESCRIPTION OF THE INVENTION

After the hotmelt adhesive has been introduced into the tubular film, the strand obtained is solidified in a preferably water-filled immersion tank. The film-wrapped adhesive strand remains in the tank for about 15 minutes to 1 hour.

The filled tubular film immersed in the cooling bath, which has a lower density than the usual cooling liquid, water, is prevented from kinking under the effect of the hydrostatic pressure built up and hence from splitting with leakage of the still liquid hotmelt adhesive by bringing the tubular film into a substantially horizontal position and leaving it in that position in the cooling bath at least until the contents of the tubular film have at least partly solidified.

The choice of the tubular films used is determined by the requirement that the film should lend itself to complete and homogeneous mixing with the hotmelt adhesive in the melting tank of the user. The use of tubular films consisting of polyolefin, more particularly polyethylene, is particularly advantageous.

In another advantageous embodiment, strands of hotmelt adhesive of predetermined length are produced by closing the tubular film by twisting about its longitudinal axis or by pinching after it has been filled with a predetermined quantity of hotmelt adhesive and then continuing the filling process. Short interconnected strand sections are obtained in this way and may be separated from one another after cooling or even later. There is no need for additional foreign substances to seal the packs. The amount of wrapping film required, based on the wrapped hotmelt adhesive, is particularly small when the strand sections have a length-to-diameter ratio of around 2:1 to 3:1. In addition, strand sections with a diameter of around 80 mm are particularly advantageous for the user.

Endless tubular films may be used in the process according to the invention. However, it is of greater advantage to produce the tubular film used during the filling process by welding a film web on the guide.

To bring the tubular film immersed in the cooling bath into the substantially horizontal position, another advantageous embodiment of the invention is characterized in that the tubular film is guided over a deflecting roller. If, after filling with a predetermined quantity of hotmelt adhesive, the tubular film is closed by twisting about its longitudinal axis or by pinching so that sausage-like interconnected strand sections are obtained, it is additionally of advantage if, during the downward movement of the tubular film in the cooling bath, the deflecting roller applied to the join between two strand sections moves downwards at the same speed. When the strand section to the lower end of which the deflecting roller is applied is fully immersed in the cooling bath, the deflecting roller can be moved upwards again so that the roller is applied to the following join between two strand sections and moves down again with those strand sections. The deflecting roller may be moved, for example, by a pneumatic cylinder.

After passing around the deflecting roller, the tubular film can readily be kept in a horizontal position inside the cooling bath by being guided through a tube horizontally arranged in the cooling bath. The tube represents the actual transport element in the cooling bath. In another advantageous embodiment, water is additionally passed through the tube in the direction of movement of the tubular film. The stream of water enhances the cooling effect by intensifying heat transfer at the tubular film. In addition, the additional stream of water surrounds the tubular film and thus reduces its contact with the tube walls. The risk of damage to the thin film is thus greatly reduced. Another advantage lies in the fact that the vigorous stream of water ensures gentle transport. In contrast to this, it would be necessary in the case of mechanical conveyors, for example conveyor belts, to ensure synchronization with the filling machine by complicated circuits and drive units. Where the above-mentioned tube is used, the filling machine can be readily operated at high speed and switched off in emergencies without further measures.

If the cooling zone in the cooling bath is larger than the dimensions of the bath, for example in the case of a high-speed filling machine, the tubular film can be deflected after passing through the tube mentioned (first tube) and guided through another tube. The tubular film emerging from the first tube may be deflected particularly easily by means of a deflecting roller or drum, more particularly a driven guide or drum.

One example of embodiment of the invention is described in detail in the following with reference to the accompanying drawings, wherein:

FIG. 1 schematically illustrates a filling machine for hotmelt adhesives using the process according to the invention.

Figure 1:
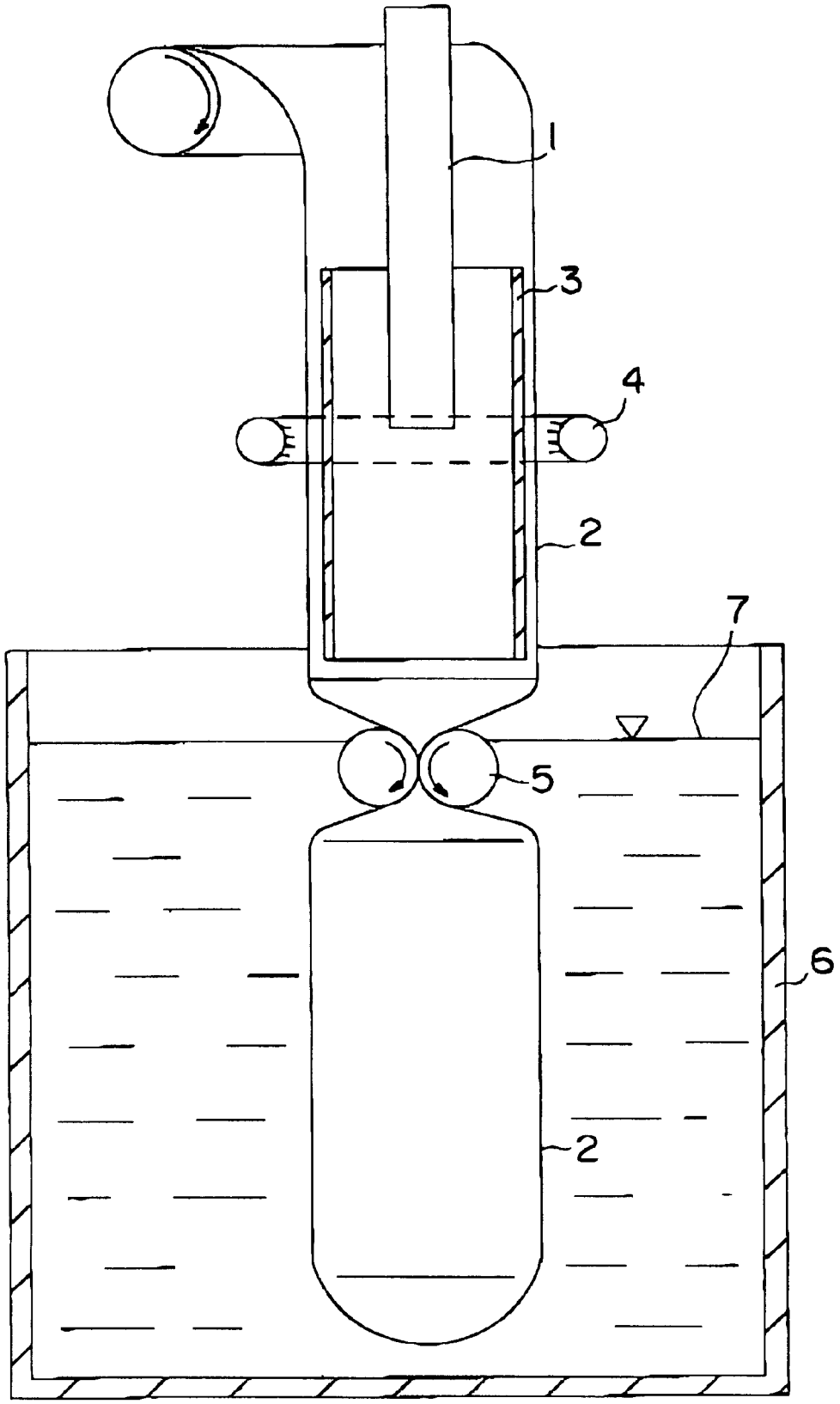

In the machine schematized in FIG. 1, tubular film 2 is filled with hotmelt adhesive at 160° C. The hotmelt adhesive is delivered to tubular film 2 through a heated dipping tube 1. The tubular film 2 is kept in the intended shape and, in particular, at the intended diameter by a guide basket 3 or is inflated by compressed air. In this case, the proposed diameter is 80 mm. A nozzle ring 4 is arranged where the adhesive emerges from the dipping tube. The nozzle ring 4 is an annular distributor provided with nozzles from which water is sprayed against the tubular film 2 in such a way that a continuous film of water flows down the film. Drive rollers and pinching rollers 5 transport the film and close the individual sausage-like strand sections. The strand sections are further cooled by a cooling water tank 6 which will be discussed in more detail hereinafter.

The drive rollers and pinching rollers are cooled. In addition, the strand sections should be closed below the surface of the cooling water 7 so that the film is not locally overheated.

After the individual strand sections have been closed by pinching, they are either immediately cut by a blade (not shown) or are separated by a cutting machine after cooling and solidification of the product.

Figure 2:
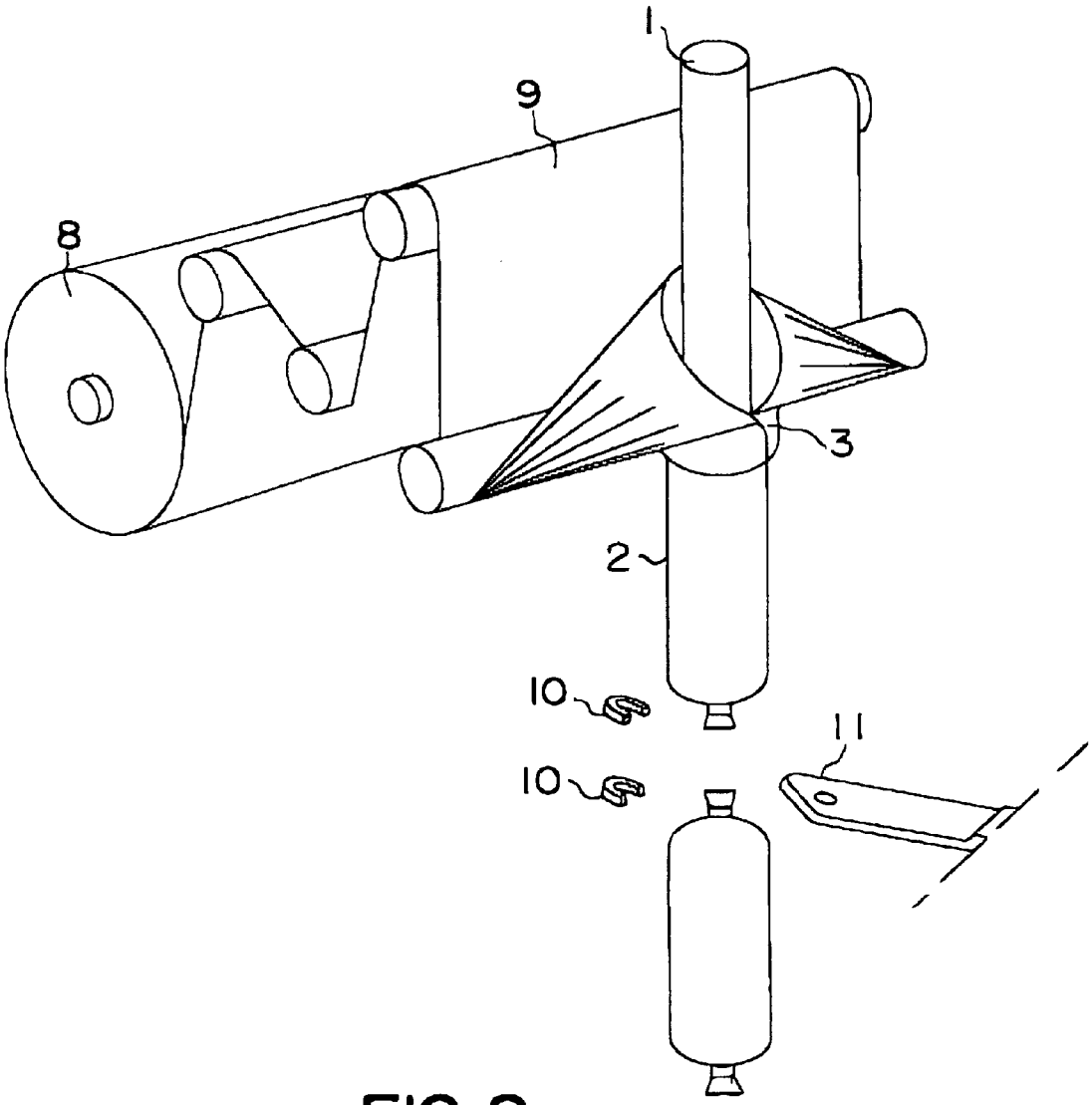
FIG. 2 is a perspective view of the guiding of the film in the machine shown in FIG. 1.

The film guide systems schematized in FIG. 1 is shown in more detail in FIG. 2. The film 9 delivered from a roll 8 is shaped into a tube at the guide basket 3 and welded directly on the guide basket 3. The tubular film 2 is filled with the hotmelt adhesive through the dipping tube 1. The drive rollers 5 transport the film-wrapped adhesive strand 2. The strand 2 is closed by twisting of the tube. The ends of the tube may also be closed by metal clips 10. Finally, the individual strand-like adhesive packs are separated by a blade 11.

Figure 3:
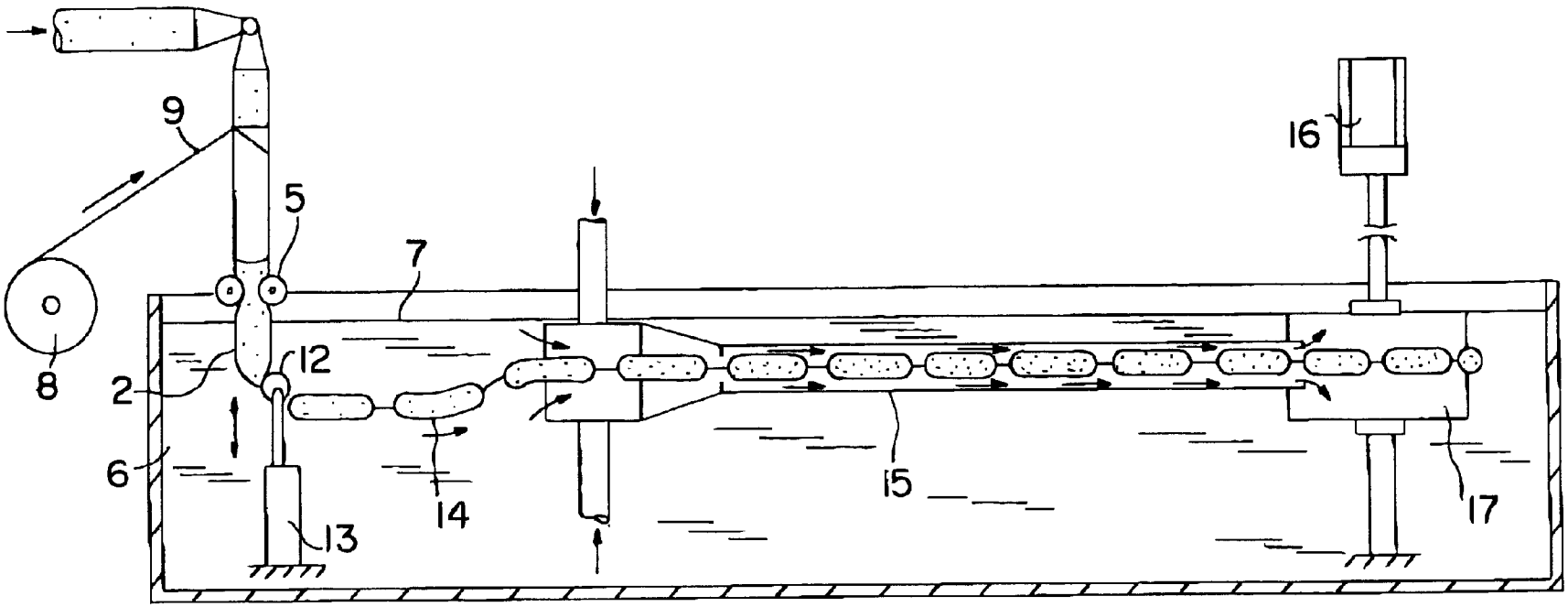
FIG. 3 is a section through the cooling bath.

FIG. 3 shows in detail the construction of a cooling bath with which the process according to the invention may be carried out. Both here and in the other figures, the same parts are denoted by the same reference numerals.

After immersion, the tubular film 2 filled with the liquid hotmelt adhesive is brought into a substantially horizontal position at a deflecting roller 12. The deflecting roller 12 is moved downwards by a pneumatic cylinder 13 at the same speed as the tubular film 2 until the strand section just entering the cooling bath is completely below the surface 7 of the cooling bath. The cylinder 13 then moves the deflecting roller upwards again to the next joint between two strand sections. The deflecting roller 12 is permanently applied to the tubular film and thus keeps the sausage-like chain of strand sections 14 under water.

Figure 4:
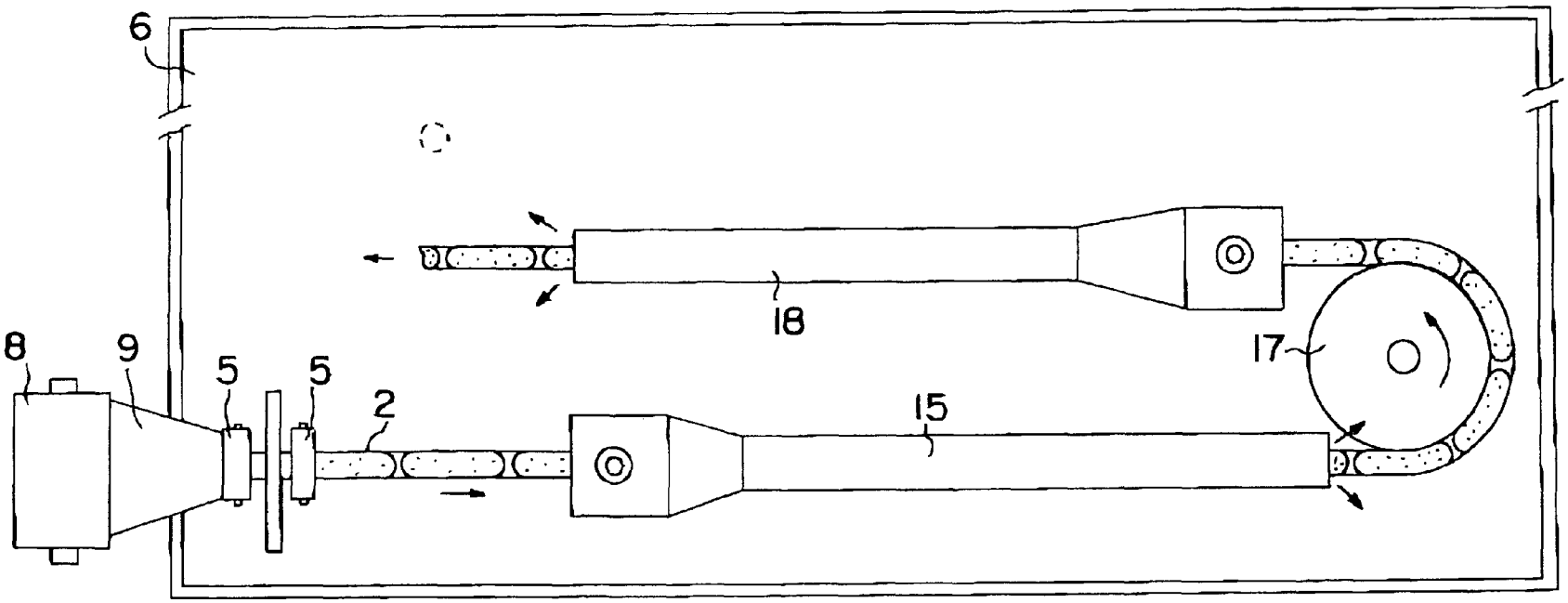
FIG. 4 is a plan view of the cooling bath shown in FIG. 3.

After deflection, the chain 14 enters a horizontal tube 15 arranged inside the cooling bath. At the same time, cooling water flows in tangentially, in the embodiment illustrated at a rate of 20 $m^3/h$ and under a pressure of about 5 bar. The vigorous stream of water inside the tube 15 transports the chain of strand sections to the end of the tube and keeps it away from the inner walls thereof. After emerging from the tube 15, the first tube, the chain 14 is turned through 180° at a deflecting drum 17 driven by a motor 16 and enters a second tube 18 which is constructed in the same way as the tube 15. Thus, in one special embodiment, five tubes are provided with the corresponding deflecting rollers. After emerging from the last tube (the tube 18 in FIG. 4), the chain 14 of strand sections can be removed from the water bath. The length of the cooling zone and hence to number of tubes are selected so that the temperature at the core of the adhesive strands has fallen below the yield point of the adhesive by the time the chain 14 has passed through the entire cooling zone (in FIG. 4, the tubes 15 and 18).

Using this process and this machine, it is possible, for example, to wrap the medium-viscosity contact hotmelt adhesive Technomelt® Q8412-22 (a product of Henkel KGaA) in a polyethylene film with a melt index according to DIN 53738 in the range from 4.1 to 7 g/10 mins.

What is claimed is:

1. A process for the production of a strand-form hotmelt adhesive comprising:

(a) introducing liquid hotmelt adhesive into a tubular film, which tubular film is suitable for melting together with the hotmelt adhesive and which is not tacky at normal storage temperatures, to fill a portion of said tubular film with said liquid hotmelt adhesive;

(b) cooling the outside of said tubular film by contact with a flowing cooling liquid in proximity to the point where said liquid hotmelt adhesive is introduced into said tubular film, whereby said tubular film is cooled while said liquid hotmelt adhesive is being introduced into said tubular film;

(c) providing at least one member selected from the group, consisting of excess gas pressure and a guide inside said tubular film to stabilize the shape of said tubular film while said hotmelt adhesive is introduced into said tubular film;

(d) immersing said portion of said tubular film in a cooling bath after filling said portion of said tubular film with said hotmelt adhesive, to cool said hotmelt adhesive.

2. The process of claim 1 wherein said hotmelt adhesive is a contact hotmelt adhesive.

3. The process of claim 1 wherein said cooling liquid is water.

4. The process of claim 1 wherein the shape of said tubular film is stabilized by providing excess gas pressure.

5. The process of claim 4 wherein said excess gas pressure is provided by means of compressed air.

6. The process of claim 1 wherein the shape of said tubular film is stabilized by providing a guide.

7. The process of claim 6 wherein said guide is a guide basket.

8. The process of claim 1 wherein said cooling bath is a water bath.

9. The process of claim 1 wherein said tubular film comprises a polyolefin.

10. The process of claim 1 wherein said tubular film comprises polyethylene.

11. The process of claim 1 further comprising closing said portion of said tubular film, after it has been filled with a predetermined quantity of said hotmelt adhesive, by twisting said tubular film about a longitudinal axis or by pinching to produce a strand section and a new portion and continuing introducing said liquid hotmelt adhesive into the new portion of said tubular film.

12. The process of claim 11 wherein said strand section has a length-to-diameter ratio of about 2:1 to 3:1.

13. The process of claim 1 wherein said tubular film is produced during introducing said hotmelt adhesive by welding of a film web on a guide.

14. The process of claim 1 further comprising guiding said tubular film by means of a deflecting roller means in said cooling bath.

15. The process of claim 14 further comprising closing said portion of said tubular film, after it has been filled with a predetermined quantity of hotmelt adhesive, by twisting said tubular film about a longitudinal axis or by pinching to produce a first strand section with a joint, continuing introducing said liquid hotmelt adhesive into a new portion of said tubular film to produce a second strand section, applying said deflecting roller means to the joint between said first and second strand sections, and moving, during the immersing of said tubular film in said cooling bath, said deflecting roller means downwards at the same speed as the joint between said first and second strand sections.

16. The process of claim 14 wherein, said tubular film is guided through a first tube arranged horizontally in the cooling bath.

17. The process of claim 16 further comprising passing water through said first tube in a direction of movement of said tubular film.

18. The process of claim 16 further comprising, after passing through said first tube, said tubular film is deflected and guided through a second tube arranged horizontally in the cooling bath.

19. The process of claim 18 wherein said tubular film is deflected and guided, as it emerges from said first tube, by a guide roller or drum.

20. The process of claim 19 wherein said guide roller or drum is a driven guide roller or drum.

21. The process of claim 1 further comprising arranging said immersed portion of said tubular film substantially horizontal and keeping said portion of said tubular film substantially horizontal in said cooling bath at least until said hotmelt adhesive in said portion of said tubular film has at least partly solidified.

22. A process for the production of a strand-form hotmelt adhesive comprising:

(a) introducing a liquid hotmelt adhesive into a tubular film, which tubular film is suitable for melting together with the hotmelt adhesive and which is not tacky at normal storage temperatures, to fill at least a portion of said tubular film with said liquid hotmelt adhesive;

(b) contacting the outside of said tubular film with flowing cooling liquid in proximity to the point where said liquid hotmelt adhesive is introduced into said tubular film whereby said tubular film is cooled while said liquid hotmelt adhesive is being introduced into said tubular film;

(c) providing at least one member selected from the group consisting of excess gas pressure and a guide inside said tubular film to stabilize the shape of said tubular film while said hotmelt adhesive is introduced into said tubular film;

(d) immersing in a cooling bath said portion of said tubular film after filling with said hotmelt adhesive to cool said hotmelt adhesive;

(e) arranging said immersed portion of said tubular film substantially horizontal in said cooling bath and keeping said portion of said tubular film substantially horizontal in said cooling bath at least until said hotmelt adhesive in said portion of said tubular film has at least partly solidified.

23. A process for production of a hot melt adhesive package in which a hot melt adhesive composition is enveloped by a film material which is meltable together with the adhesive composition without substantially affecting the adhesive property of said composition, said process comprising the steps of:

a) Forming a sheet of the film material having a first and second lateral edge into a tubular shape on a support and joining said lateral edges of said sheet while maintaining the tubular shape of the film material;

b) Introducing said adhesive composition in liquid form into the tubular film material at a temperature above the melting point of the film material;

c) Cooling the tubular film material containing said adhesive composition by immersion of the lower end of the tube in a cooling medium;

d) Closing the tubular film material containing said adhesive composition to envelop said composition with said film material thereby providing said hot melt adhesive packaging; and e) Immersing said hot melt adhesive package in the cooling medium.

24. The process according to claim 23 wherein said adhesive is a strand form contact hot melt adhesive.

25. The process according to claim 24 wherein the strand has a length to diameter ratio of between 2:1 and 3:1.

26. The process according to claim 25 wherein said strand has a diameter of about 80 millimeters.

27. The process according to claim 23 wherein said hot melt adhesive composition is a styrene-butadiene copolymer.

28. The process according to claim 23 wherein said hot melt adhesive further comprises a cohesive component and an additive.

29. The process according to claim 23 wherein said film material is polyethylene.

30. The process according to claim 29 wherein said polyethylene has a melt index between about 4.1 and about 7 g/10 min.

31. The process according to claim 23 wherein said cooling medium is a water bath.

32. The process according to claim 23 wherein said tubular film is sealed by pinching the film.

33. The process according to claim 23 wherein the tubular shape of the film material of subparagraph (a) is maintained by gas pressure exerted within said film material.

34. The process according to claim 23 wherein the film material is uncoated.

35. The process according to claim 23 wherein the hot melt adhesive comprises a homogenous mixture of substances which form the adhesive component, the cohesive component and the additive components.

36. The process according to claim 23 wherein the hot melt adhesive comprises at least one of the group consisting of ethylene/vinyl acetate copolymer, styrene copolymer and block polymer.

37. The process according to claim 23 wherein the adhesive composition is introduced at 160° C.

38. The process according to claim 23 wherein the film wrapped adhesive remains in the cooling medium for about 15 minutes to one hour.

39. The process according to claim 23 wherein the polyethylene film has a melt index between 4.1 and 7 g/10 min.

40. A process for continuous production of a hot melt adhesive package in which a hot melt adhesive composition is enveloped by a film material which is meltable together with the adhesive composition without adversely affecting the adhesive property of said composition, said process comprising the steps of:

a. Forming a sheet of the film material having a first and a second lateral edge into a tubular shape on a support and joining said lateral edges of said sheet while maintaining the tubular shape of the film material;

b. Introducing said adhesive composition in liquid form into the tubular shaped film material at a temperature above the melting point of the film material;

c. Cooling the outer surface of the film material to below its melting point during the introduction of the adhesive composition therein;

d. Closing the tubular film material containing said adhesive composition at spaced-apart locations along the length of said film to envelop said composition within said film material thereby producing said hot melt adhesive package; and e. Immersing said hot melt adhesive package in the cooling medium.

41. The process according to claim 40 wherein the tubular shape of the film material of subparagraph a is maintained by gas pressure exerted within said film material.

42. The process according to claim 40 wherein the film material is uncoated.

43. The process according to claim 40 wherein said hot melt adhesive composition is a styrene-butadiene copolymer.

44. The process according to claim 40 wherein said hot melt adhesive further comprises a cohesive component and an additive.

45. The process according to claim 40 wherein said film material is polyethylene.

46. The process according to claim 40 wherein said cooling medium is a water bath.

47. The process according to claim 40 wherein the hot melt adhesive comprises a homogenous mixture of substances which form the adhesive component, the cohesive component and the additive component.

48. The process according to claim 40 wherein the hot melt adhesive comprises at least one of the group consisting of ethylene/vinyl acetate copolymer, styrene copolymer and block copolymer.

49. The process according to claim 40 wherein the adhesive composition is introduced at 160° C.

50. The process according to claim 40 wherein the film wrapped adhesive remains in the cooling medium for about 15 minutes to one hour.

51. The process according to claim 40 wherein the polyethylene film has a melt index between 4.1 and 7 g/10 min.

52. A continuous process for production of a hot melt adhesive package in which a hot melt adhesive composition is enveloped by a film material which is meltable together with the adhesive composition without substantially affecting the adhesive property of said composition, said process comprising the steps of:

a. Forming a sheet of the film material having a first and a second lateral edge into a tubular shape on a support and joining said lateral edges of sad sheet while maintaining the tubular shape of the film material;

b. Introducing said adhesive composition in liquid form into the tubular shaped film material at a temperature above the melting point of the film material;

c. Cooling the tubular film material containing said adhesive composition by immersion of the lower end of the tube in a cooling medium;

d. Closing the tubular film material containing did adhesive composition at spaced apart locations along the length of said film tube to envelop said composition within said film material thereby producing did hot melt adhesive package; and e. immersing said hot melt adhesive package in the cooling medium.

53. The process according to claim 52 wherein said adhesive is a strand form contact hot melt adhesive.

54. The process according to claim 52 wherein said film material is polyethylene.

55. The process according to claim 52 wherein said cooling medium is a water bath.

56. The process according to claim 52 wherein said tubular film is sealed by pinching the film.

* * * * *

UNITED STATES PATENT AND TRADEMARK OFFICE

CERTIFICATE OF CORRECTION

PATENT NO. : 6,138,441
DATED : October 31, 2000
INVENTOR(S) : Kik et al.

It is certified that error appears in the above-identified patent and that said Letters Patent is hereby corrected as shown below:

Column 10,
Line 11, delete “sad”, and insert therefor -- said --.
Lines 19 and 22, delete “did”, and insert therefor -- said --.

Signed and Sealed this

Thirtieth Day of September, 2003

JAMES E. ROGAN
*Director of the United States Patent and Trademark Office*